US006408523B1

(12) United States Patent
Schmidt

(10) Patent No.: US 6,408,523 B1
(45) **Date of Patent: *Jun. 25, 2002**

(54) SCISSORS

(76) Inventor: Hardi Schmidt, Nümmener Strasse 70, Solingen (DE), 42653

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 100 days.

(21) Appl. No.: 09/068,608

(22) PCT Filed: Mar. 1, 1997

(86) PCT No.: PCT/DE97/00375

§ 371 (c)(1),
(2), (4) Date: May 11, 1998

(87) PCT Pub. No.: WO97/38829

PCT Pub. Date: Oct. 23, 1997

(30) Foreign Application Priority Data

Apr. 13, 1996 (DE) ..... 196 14 691

(51) Int. Cl.[7] ..... B26B 13/28

(52) U.S. Cl. ..... 30/254; 30/266; 30/270; 411/512

(58) Field of Search ..... 30/134, 136, 261, 30/262, 267, 268, 269, 270, 266; 403/118, 119, 156; 411/405, 352, 353, 512, 103

(56) References Cited

U.S. PATENT DOCUMENTS

| | | | | |
|---|---|---|---|---|
| 624,175 | A | * | 5/1899 | Chapman |
| 2,776,482 | A | * | 1/1957 | Hafekost |
| 3,672,053 | A | | 6/1972 | Wiss |
| 4,345,378 | A | * | 8/1982 | Pracht |
| 5,319,854 | A | * | 6/1994 | Pracht |

FOREIGN PATENT DOCUMENTS

| | | | |
|---|---|---|---|
| DE | 2458218 | * | 12/1974 |
| DE | G8137176 | | 12/1981 |
| DE | 3141551 | * | 5/1983 |
| EP | 0515830 | | 4/1992 |

* cited by examiner

*Primary Examiner*—Kenneth E. Peterson
(74) *Attorney, Agent, or Firm*—Diller, Ramik & Wight

(57) ABSTRACT

A pair of scissors, in particular haircutting scissors, has a hinged joint consisting of a hinge screw (3) and a screw nut (4). The hinge screw (3) is essentially non-rotatably connected to one scissors half (2) and the screw nut (4) engages in a bore (12) in this scissors half (2). Situated in said bore (12) is a first flexible body (15) which, under contact pressure, sits against the end of the screw nut (4) facing the head (5) of the hinge screw (3) and against the shaft (9) of the hinge screw (3). To ensure that even a short screw nut will be securely held and can be precisely adjusted, the invention provides that the screw nut (4) has on its outer circumference a groove (18) in which is situated a second flexible body (19) which, under contact pressure, sits against the screw nut (4) and the bore (12) in the scissors half (2).

6 Claims, 3 Drawing Sheets

SCISSORS

BACKGROUND OF THE INVENTION

The invention relates to a pair of scissors, in particular hair-cutting scissors, with a hinged joint consisting of a hinge screw and a screw nut, where the hinge screw is essentially non-rotatably connected to one scissors half and the screw nut engages in a bore in this scissors half, in which a first flexible body is situated which, under contact pressure, sits against the end of the screw nut facing the head of the hinge screw and against the shaft of the hinge screw.

A pair of scissors of this kind is known from EP 0515830 A1. In these scissors, the screw nut of the hinged joint is made of steel or another material and its inner wall displays an annular groove in which a second annular body, made of a flexible material, is located, the inside diameter of which is smaller than the thread diameter of the hinge screw. As a result of the combination of this first flexible body, inserted in the bore for the screw nut and the second flexible body located on the inner wall of the screw nut, both of which sit against the shaft of the hinge screw under contact pressure, any clearance between the hinge screw and the scissors half displaying the screw nut—the upper scissor blade—is avoided for the following reasons.

Although the hinge screw is essentially non-rotatably connected to the upper scissor blade by two opposing milled surfaces and a correspondingly shaped opening in the upper scissors half, some play of the hinge screw in the opening in the upper scissors half cannot be entirely avoided during mass production of scissors of this kind for manufacturing reasons. In today's precision scissors with a very low closing pressure, this play manifests itself in the form of slight jerks during use of the scissors, this being perceived as unpleasant by the person using the scissors, such as the hairdresser. Moreover, the hinge screw is subject to greater wear as a result of this jerking effect. It has been found that, particularly in the case of scissors with a low closing pressure, the two flexible bodies provided pursuant to EP 0515830 A1 are perfectly sufficient for avoiding the production-related play between the hinge screw and the upper scissor blade, in that the two flexible bodies sit against both the shaft of the hinge screw and against the upper scissor blade, or the screw nut fixed on it, under contact pressure and thus establish an adequate frictional connection between the hinge screw and the upper scissor blade.

However, the solution known from EP 0515830 A1 has the drawback that, in the case of short screw nuts, the annular groove formed on the inner wall to accommodate the annular flexible body greatly reduces the thread length of the screw nut, meaning that retention of the screw nut in the upper scissor blade may be impaired under certain circumstances. As it is most important to have a tight fit which does not loosen, and also accurate, sensitive adjustment of the screw nut in order to obtain the desired closing pressure of the scissors, the screw nut must have a sufficiently long internal thread.

The present invention is therefore based on the task of further developing a pair of scissors of the type mentioned at the start in such a way that, even in the case of relatively short screw nuts, reliable retention and accurate adjustment of the same in the upper blade of the scissors are guaranteed, while preserving the advantages of the scissors known from EP 0515830 A1.

According to the invention, this task is solved in that the screw nut of a pair of scissors of the type mentioned at the start displays a groove around its circumference, in which a second flexible body is located which sits against the screw nut and the bore in the scissors half under contact pressure.

The invention makes use of a frictional connection between the hinge screw and the upper blade of the scissors. In contrast to EP 0515830, this connection does not run via the first flexible body to the upper scissor blade and via the second flexible body to the screw nut, but via the first flexible body and via the screw nut and the second flexible body to the upper scissor blade. It has surprisingly been found that, in order to solve the task, it is perfectly sufficient for the first flexible body to sit against the shaft of the hinge screw under contact pressure. The desired frictional connection between the screw shaft and the upper scissor blade, and also the targeted good fit of the screw nut thread even with a short nut, and the sensitive adjustment for setting the closing pressure, are achieved by the full length of the nut being used for the thread in order to position the nut in the upper scissor blade in non-positive fashion by the first flexible body, on the one hand, and by the second flexible body, on the other.

In particular, the invention permits a screw nut which can be located entirely, or almost entirely, within the upper scissor blade and whose end facing away from the head of the hinge screw is positioned essentially flush with the upper side of the corresponding scissors half. A pair of scissors designed in this way has the advantage that the hair cannot become entangled, as usually happens with a projecting screw, and that the hairdresser can easily cut along the comb as a result.

Although a screw nut with a neck is known from EP 0515830 A1, on the circumference of which a flexible O-ring is inserted in a corresponding annular groove, this flexible O-ring is merely intended as an alternative to the first flexible body inserted in the hinge bore in the upper scissor blade, and likewise only in combination with the flexible O-ring located on the inner wall of the screw nut. It is not suitable for solving the task on which the present invention is based, either in this combination or in isolation. The combination of two flexible bodies in accordance with the invention contradicts the theory of EP 0515830 A1, as this bindingly prescribes the use of one of the flexible bodies on the inner wall of the screw nut in both of the alternatives described.

DE 81 37 176 U1 shows a screw nut with a flexible body located in an annular groove on the circumference, said body being seated against the screw nut and the bore in the scissors half under contact pressure. However, there is no provision for a flexible body located between the shaft of the hinge screw and the upper scissor blade or the screw nut. Consequently, this design is incapable of avoiding production-related play between the hinge screw and the upper blade of the scissors, the result being that the disadvantages eliminated by DE 81 37 176 U1 and the present invention appear, that is to say jerking during professional use of scissors of this kind with a very low closing pressure and elevated wear.

SUMMARY OF THE INVENTION

In a preferred configuration of the invention, the groove located on the circumference of the screw nut is designed as an annular groove, and the second flexible body seated therein is designed in an O-ring.

In order to increase the contact pressure under which the first flexible body sits against the hinge screw, the inside diameter of the same can be designed smaller than the thread diameter of the hinge screw.

The bore serving to engage the screw nut preferably displays a narrow area at the end facing the other scissors half, where the first flexible body sits against this narrow area. In particular, the cross-section of the narrow area can essentially correspond to the cross-section of the shaft of the joint screw in order to achieve essentially non-rotatable mounting of the joint screw. In this context, the first flexible body is preferably designed as a moulded part with spatial dimensions corresponding to the geometry of the narrow area.

In a further expedient configuration of the invention, the narrow area and, accordingly, the second flexible body are of conical design.

A preferred practical example of the invention is described in more detail below on the basis of the drawings. The drawings show the following:

DESCRIPTION OF THE PREFERRED EMBODIMENTS

Figure 1:
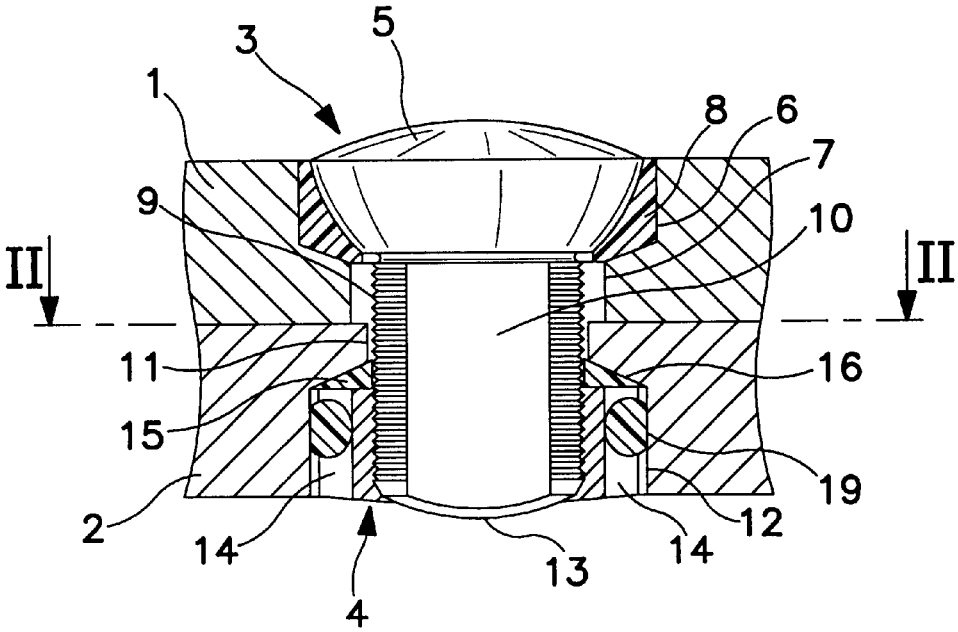
FIG. 1 A longitudinal section through the hinge joint of the practical example, FIG. 2 A section along line II—II in FIG. 1, FIG. 3 A side view of the hinge screw, FIG. 4 A top view of the face end of the screw nut, FIG. 5 A longitudinal section through the screw nut, FIG. 6 A longitudinal section through the first flexible body, FIG. 7 A top view of the face end of the first flexible body, and FIG. 8 A cross-section through the shaft of the joint screw.
Figure 2:
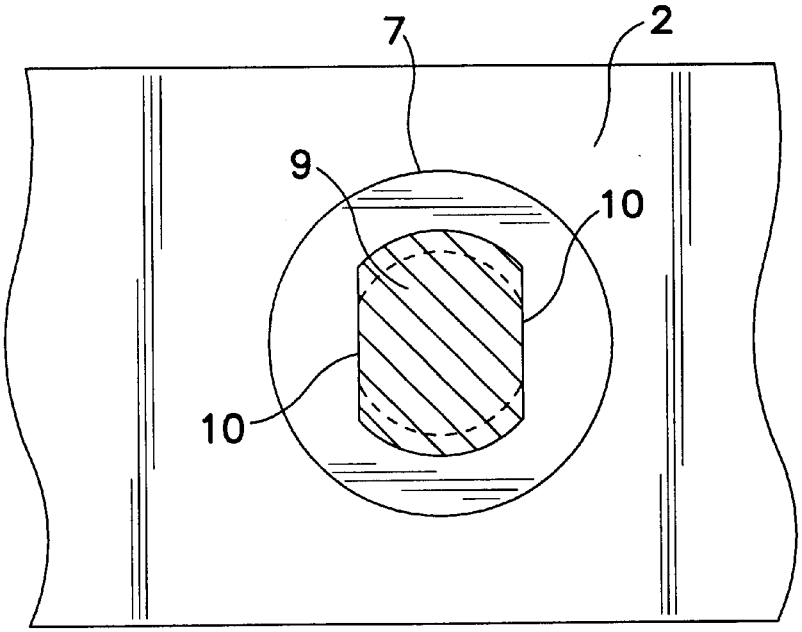
Figure 3:
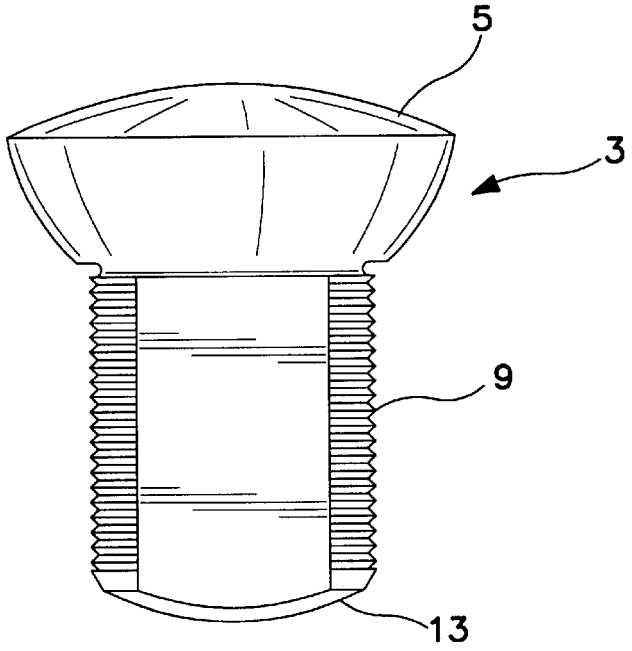

As can be seen from FIG. 1, in particular, the two scissors halves 1 and 2 of the pair of scissors under consideration are connected by means of a hinge screw 3 and a screw nut 4.

The rear side 5 of the head of hinge screw 3 is dome-shaped on the circumference, this part lying in a wider end area or counter bore 6 of bore 7 in scissors half 1, referred to as the lower scissor blade. Head 5 is carried in this wider end area 6 by plastic sliding anti-friction ring 8.

Shaft 9 of hinge screw 3 includes two diametrically opposite parallel flat surfaces 10 on its sides. While shaft 9 is located with play in bore 7 of lower scissor blade 1, it reaches through an opening or bore 11 in scissors half 2, referred to as the upper scissor blade, which displays flat areas corresponding to the flat areas 10 of shaft 9, meaning that hinge screw 3 is substantially non-rotatably connected to upper scissor blade 2.

As can also be seen from FIG. 1, screw nut 4, which is guided on the threaded end of shaft 9 of hinge screw 3, fits into a bore 12, located in upper scissors blade 2, meaning that end 13 of screw nut 4 facing away from head 5 of hinge screw 3 is located essentially flush with the upper side of upper scissor blade 2. Two recesses 14, which extend axially on the circumference and are illustrated in a top view in FIG. 4, are provided to allow screw nut 4 to be operated by means of a tool.

Figure 6:
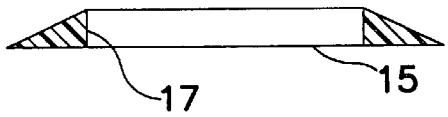
Figure 7:
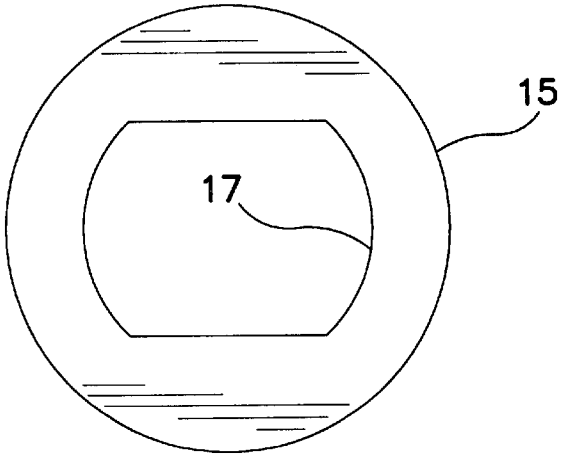
Figure 8:
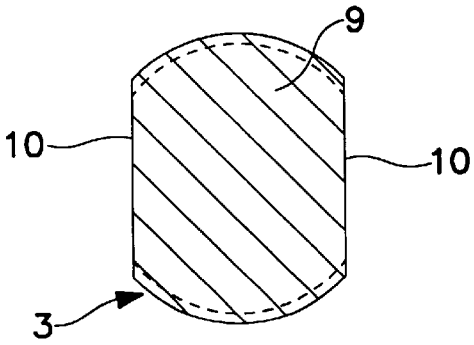

Located in bore 12 of upper scissor blade 2 is a first flexible body 15 which, owing to being oversized, sits under contact pressure against the bore wall of the end of screw nut 4 facing head 5 of hinge screw 3 and against shaft 9 of hinge screw 3. The first flexible body 15 is designed as a moulded part, as indicated in more detail in FIGS. 6 and 7. The annular moulded part is designed with one conical end, this sitting against a likewise conically shaped transition surface 16 between opening 11 and bore 12 in the upper scissor blade. The geometry of opening 17 in body 15 corresponds to opening 11 in upper scissor blade 2 of shaft 9 of hinge screw 3, although the inside dimensions are smaller than those of opening 11 or shaft 9 of hinge screw 3. Flexible body 15 is manufactured in the form of a rubber-like, highly elastic plastic injection-moulded part.

Figure 4:
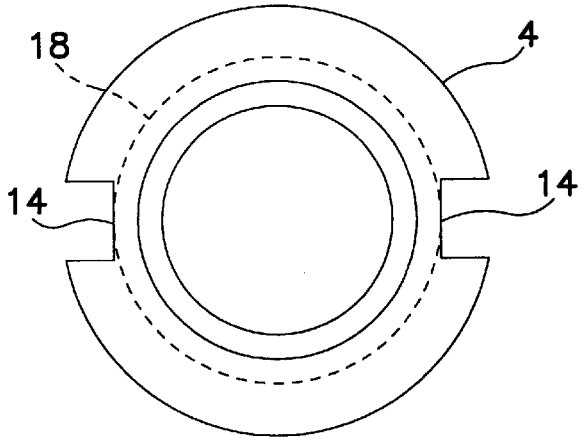
Figure 5:
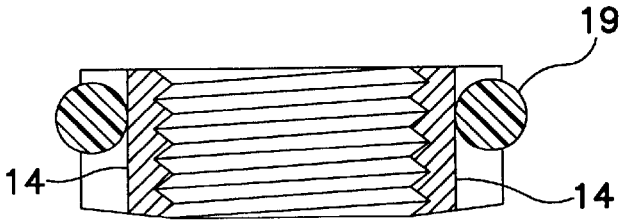

As indicated by FIG. 1, and particularly by FIGS. 4 and 5, the circumference of screw nut 4 includes a groove 18, in which a second flexible body 19 is located, which sits against screw nut 4 and bore 12 in upper scissor blade 2 under contact pressure. Groove 18 is designed as an annular groove and the second flexible body 19 mounted therein is designed as an O-ring.

Consequently, this results in a frictional connection between hinge screw 3 and upper scissor blade 2 of the pair of scissors, this connection running via the first flexible body 15 and via the screw nut 4 and the second flexible body 19 to the upper scissor blade 2.

Although a preferred embodiment of the invention has been specifically illustrated and described herein, it is to be understood that minor variations may be made in the apparatus without departing from the spirit and scope of the invention, as defined the appended claims.

What is claimed is:

1. A pair of scissors comprising a first scissors half (1) and a second scissors half (2), said first scissors half (1) having a first bore (6, 7), said second scissors half (2) having a second bore (11, 12, 16), said bores (6, 7; 11, 12, 16) being generally in alignment; said second bore (11, 12, 16) being defined by an opening-defining surface (11) adjacent said first bore (6, 7), an enlarged bore-defining surface (12) remote from said first bore (6, 7) and a transition surface (16) between said opening-defining surface (11) and said enlarged bore-defining surface (12); a hinge screw (3) having a head (5) substantially disposed in said first bore (6, 7) and a threaded shaft (9) thereof disposed in said first bore (6, 7) and said second bore (11, 12, 16); said threaded shaft (9) having an exterior peripheral surface in substantially non-rotatable matching conforming relationship to said opening defining surface (11) thereby effecting non-rotatable relationship therebetween, said second scissors half (2) including opposite first and second surfaces with the second scissors half first surface being in rotatable contact with an opposing surface of said first scissors half (1); a screw nut (4) having internal threads in threaded relationship to said threaded shaft (9) and an outwardly opening circumferential groove (18); said screw nut (4) being substantially housed within said enlarged bore-defining surface (12) and including axially spaced first and second end faces with said second end face being substantially flush with said second surface of said second scissors half (2); a first flexible body (19) being seated in said outwardly opening circumferential groove (18) and being in yieldable pressure contact with said enlarged bore-defining surface; and a second flexible body (15) being disposed in contacting relationship between said screw nut first axial end face and said transition surface (16) whereby said first (19) and second (15) flexible bodies cooperatively function to establish a yieldable frictional connection between the hinge screw (3) and the second scissors half (2) upon the tightening of said screw nut (4) upon said threaded shaft (9) which squeezes said second flexible body (15) between said screw nut first axial end face and said transition surface (16) thereby forcing said second flexible body (15) into intimate yieldable gripping contact with said thread shaft (9) to effectively mitize said hinge screw (3) and said second scissors half (2) and avoid jerking of the scissor halves 1, 2 during pivotal motion when in use.

2. The pair of scissors as defined in claim 1 wherein the inside diameter of the second flexible body (15) is smaller than the thread diameter of said threaded shaft (9).

3. The pair of scissors as defined in claim 2 wherein the second flexible body (15) is of an annular frusto-conical configuration.

4. The pair of scissors as defined in claim 1 wherein the second flexible body (15) is of an annular frusto-conical configuration.

5. The pair of scissors as defined in claim 1 wherein the second flexible body (15) has an opening defined by an inside surface in contact against said threaded shaft (9).

6. The pair of scissors as defined in claim 5 wherein the second flexible body (15) is of an annular frusto-conical configuration.

* * * * *